United States Patent [19]

Delatte et al.

[11] Patent Number: 4,878,594

[45] Date of Patent: Nov. 7, 1989

[54] CLOSING DEVICE FOR CRYOGENIC CONTAINER

[75] Inventors: Daniel Delatte, Saint Maur; Bernard Simon, Le Plessis Trevise, both of France

[73] Assignee: L'air Liquide, Societe Anonyme pour l'etude et l'exploitation des Procedes Georges Claude, Paris, France

[21] Appl. No.: 286,952

[22] PCT Filed: Apr. 28, 1988

[86] PCT No.: PCT/FR88/00208

§ 371 Date: Nov. 21, 1988

§ 102(e) Date: Nov. 21, 1988

[87] PCT Pub. No.: WO88/08501

PCT Pub. Date: Nov. 3, 1988

[30] Foreign Application Priority Data

Apr. 30, 1987 [FR] France ..... 87 06159

[51] Int. Cl.[4] ..... B65D 51/16; F17C 13/06

[52] U.S. Cl. ..... 220/254; 220/901; 220/204; 215/355; 215/364

[58] Field of Search ..... 220/254, 901, DIG. 17, 220/353, 204, 422, 421; 215/355, 364; 62/50

[56] References Cited

U.S. PATENT DOCUMENTS

| | | | |
|---|---|---|---|
| 2,385,847 | 10/1945 | Skae | 220/254 |
| 4,230,112 | 10/1980 | Smith | 215/355 |
| 4,570,819 | 2/1986 | Perkins | 220/374 |

FOREIGN PATENT DOCUMENTS

| | | |
|---|---|---|
| 0106715 | 4/1984 | European Pat. Off. . |
| 339701 | 8/1959 | Switzerland . |
| 2063836 | 6/1981 | United Kingdom . |

*Primary Examiner*—Stephen Marcus
*Assistant Examiner*—G. W. Reece
*Attorney, Agent, or Firm*—Young & Thompson

[57] ABSTRACT

The closing device is constituted by a principal stopper (11) having a lateral notch (17) and an auxiliary stopper (12) having a general shape conjugate with that of this notch, the auxiliary stopper being provided with at least one bore (22) and means (19) for fixing on the edge of the opening of the container.

5 Claims, 1 Drawing Sheet

CLOSING DEVICE FOR CRYOGENIC CONTAINER

DESCRIPTION

The present invention relates to a closing device for a cryogenic container.

The preservation of biological products is liquid nitrogen requires the use of containers including a monitoring and, possibly, an automatic regulation of the level of the liquid nitrogen. A passage must therefore be provided for one or more probes and, possibly, for a liquid nitrogen supply pipe.

For this purpose, several arrangements have been proposed, but none has given full satisfaction:

if one is content to provide bores in the stopper of the container, there results a considerable lack of convenience for the user, since the stopper must be frequently lifted off for handling the stored products;

if one or more tubes are passed through the interwall under a vacuum of the container, a large volume of interwall must be available and this solution is costly to realize and involves a risk of leakages at the passages of the outer case and of the interior reservoir of the container;

the simple passage through a lateral notch in the stopper results in excessive entries of heat and causes the rapid appearance of frosting.

The object of the invention is to provide an economical solution which does not hinder the handling of the stopper and which practically does not cause entries of spurious heat or frosting.

For this purpose, the invention has for subject a closing device for a cryogenic container, characterized in that it comprises a principal stopper having a lateral notch and an auxiliary stopper having a general shape which is conjugate with that of this notch, the auxiliary stopper being provided with at least one bore and means for fixing to the edge of the opening of the container.

One embodiment of the invention will now be described with reference to the accompanying drawings in which.

Figure 1:
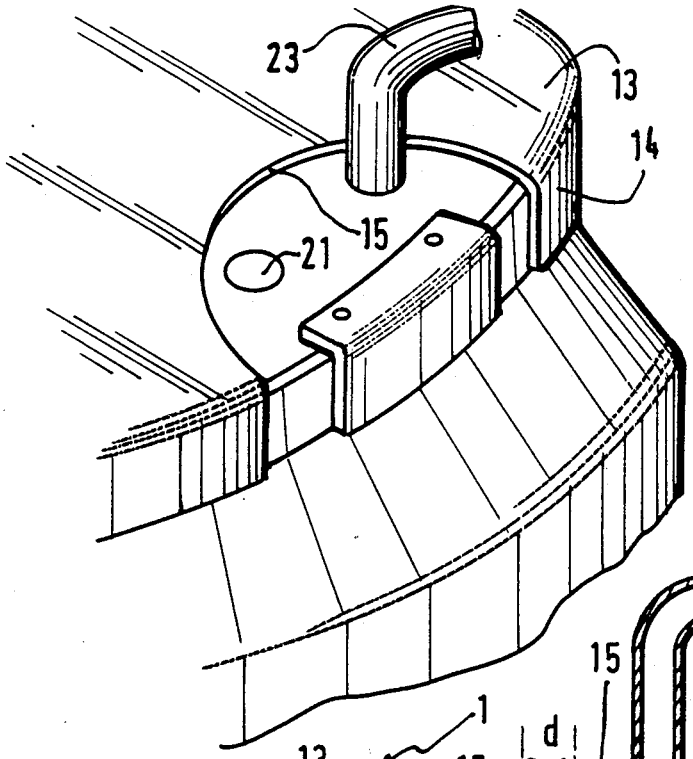
FIG. 1 is a partial perspective view of a closing device according to the invention.

The closing device 1 shown in the drawing is adapted to equip a cryogenic container 2 constituted by an interior reservoir 3, an exterior case 4 and a connecting neck 5.

The reservoir 3 terminates in a divergent frustoconical outlet 6, the case 4 in a convergent frustoconical outlet 7, and the neck 5 is a tubular section of epoxy resin whose ends are fixed by joints of adhesive 8 in these two openings. Furthermore, the free edge 9 of the opening 7 is inwardly formed over so as to cover the upper end edge of the neck 5. Defined by the reservoir 3, the case 4, and the neck 5 is an interwall 10 containing a vacuum and a multilayer insulating material not shown.

The closing device 1 is constituted by a principal stopper 11 and an auxiliary stopper 12, the assembly of the two stoppers being adapted to close the opening of the container defined by the neck 5.

The stopper 11 includes a lid 13 having a downardly-formed flange 14. When it is in position, this lid bears against the edge 9 of th container and the flange overlaps with a small clearance the upper part of the outlet 7. The lid 13 includes a lateral notch 15 having a roughly semicircular shape extending to the end of the flange 14.

Figure 2:
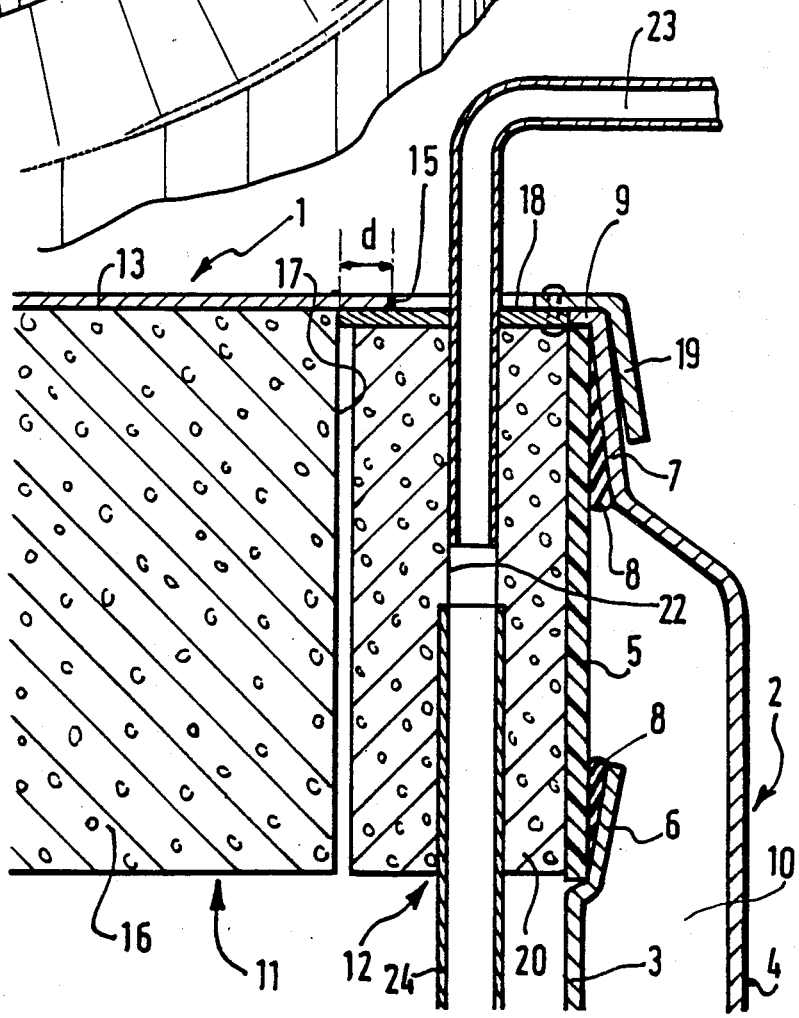
FIG. 2 is a corresponding view in section along the axis of the container.

A block 16 of polyurethane foam having a generally cylindrical shape and a diameter slightly less than the inside of diameter of the neck 5, is adhered to the lower surface of the lid 13. This block has a lateral notch 17 of the same shape as the notch 15 but a little deeper. Thus, the lid 13 overlies the notch 17 a short distance d (FIG. 2) which is uniform throughout the length of this notch.

The auxiliary stoppeer 12 comprises a planar lid 18 which has the shape of the notch 17 and on the outer edge of which there is fixed, for example riveted, a tab 19 having an overturned L-shape. A block 20 of polyurethane foam formed by the scrap obtained by cutting the notch 17 in the block 16, is adhered to the lower surface of the lid 18. This block 20 has two vertical bores; on one hand, a first bore shown in FIG. 1 provided with a flexible stopper 21 and through which may extend a liquid nitrogen supply pipe (not shown) if the containr is equipped with an automatic regulation of the level of liquid nitrogen; on the other hand, a bore 22 having an upper part of small diameter and a lower part of larger diameter.

An elbow 23, through which extends one or more probes (not shown) maintained by friction either directly by the elbow or by means of a perforated stopper (not shown) disposed in the entrance of the elbow, is fitted in the upper part of the bore 22, while a probe guide 24 is fitted in the lower part of the same passage. The elbow 23 and the tube 24 are spaced apart in order to avoid entry of heat by conduction.

In service, as represented, the auxiliary stopper 12 is permanently hooked in a detachable manner to the edge of the opening of the container by its tab 19 which marries up with the outlet 7, the cylindrical outer surface of the block 20 being applied against the neck 5. The principal stopper may be easily placed in position with a small peripheral clearance relative to the neck 5; its block 16 then marries up with the block 20 with a small clearance and its lid 13 is applied on the periphery of the lid 18. A complete composite stopper is thus constituted and forms an effective barrier against entry of heat and entry of humidity in the container 2.

Thereafter, the principal stopper may be placed in position and withdrawn without difficulty for the handling of the stored products, without shifting the auxiliary stopper 12.

As a variant, one or more throughway passages provided in the auxiliary stopper could permit the introduction in the container of other accessories, for example a liquid drawing off pipe.

We claim:

1. Closing device (1) for a cryogenic container (2), characterized in that it comprises a principal stopper (11) having a lateral notch (17) and an auxiliary stopper (12) having a general shape conjugate with that of this notch, the auxiliary stopper being provided with at least one boe (22) and means (19) for fixing said auxiliary stopper to the edge of the opening of the container.

2. Closing device according to claim 1, characterized in that the principal stopper (11) comprises a block of insulating material (16) a lateral part of which is cut away to form said notch (17) and at the same time form a second block of insulating material (20) pertaining to the auxiliary stopper (12).

3. Closing device according to claim 2, characterized in that each block of insulating material (16,20) is fixed to the lower surface of a respective lid (13,18), the lid of the principal stopper 11 overlapping the edge of the lid of the auxiliary stopper (12).

4. Closing device according to claim 1 characterized in that the fixing means 19 comprise a tab for hooking the auxiliary stopper 12 on the edge of the opening of the container.

5. Closing device according to claim 1 characterized in that the auxiliary stopper (12) comprises a bore for the passage of a liquid nitrogen supply pipe and a bore (22) for the passage of at least one probe.

* * * * *